US011435158B1

(12) United States Patent
Liao

(10) Patent No.: US 11,435,158 B1
(45) Date of Patent: Sep. 6, 2022

(54) FAST EXPANSION STRUCTURE OF TOY GUN BUTTSTOCK

(71) Applicant: GUAY GUAY TRADING CO., LTD., Changhua County (TW)

(72) Inventor: Yin-Hsi Liao, Changhua County (TW)

(73) Assignee: GUAY GUAY TRADING CO., LTD., Changhua County (TW)

( * ) Notice: Subject to any disclaimer, the term of this patent is extended or adjusted under 35 U.S.C. 154(b) by 25 days.

(21) Appl. No.: 17/203,729

(22) Filed: Mar. 16, 2021

(51) Int. Cl.
*F41C 23/04* (2006.01)
*F41B 7/08* (2006.01)

(52) U.S. Cl.
CPC ..... *F41B 7/08* (2013.01); *F41C 23/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06; F41B 7/08
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 1,410,354 A * 3/1922 White ..... F41A 19/30 89/154
RE15,801 E * 3/1924 Rychiger ..... F41A 15/14 89/169
2,483,752 A * 10/1949 Buhl ..... F41B 7/006 42/71.01
3,029,539 A * 4/1962 Glass ..... F41C 3/08 124/16
5,173,564 A * 12/1992 Hammond, Jr. ..... F41C 23/00 42/75.03
8,356,542 B2 * 1/2013 Cottle ..... F41A 19/00 89/129.02
8,371,208 B2 * 2/2013 Cottle ..... F41A 19/11 89/129.02
8,474,169 B2 * 7/2013 Cottle ..... F41C 23/14 42/73
8,806,791 B2 * 8/2014 Cottle ..... F41C 23/20 89/129.01
9,612,082 B2 * 4/2017 Cottle ..... F41C 23/10
9,612,083 B2 * 4/2017 Cottle ..... F41C 23/14
10,801,800 B1 * 10/2020 Chia ..... F41C 23/16
2014/0283809 A1 * 9/2014 Huebl ..... F41B 11/60 124/56
2016/0363412 A1 * 12/2016 EuDaly ..... F41B 7/003
2020/0182586 A1 * 6/2020 Zhang ..... F41C 23/20

* cited by examiner

*Primary Examiner* — Michael D David
(74) *Attorney, Agent, or Firm* — Leong C. Lei

(57) ABSTRACT

A fast expansion structure of a toy gun buttstock is provided. The structure includes a main body, a plurality of slide bars, a plurality of coupling portions, a plurality of fixing members, a butt piece, a plurality of rotating and retaining members, a plurality of first engaging surfaces, a plurality of second engaging surfaces, a limiting member, and a first elastic member. With the above structure, a user may pull the butt piece to cause the fixing members that are provided on the slide bars to push the rotating and retaining members for rotation so as to cause the first elastic member to push the limiting member to change the limiting member from an initial condition of contacting and pushing the first engaging surfaces to a condition of contacting and pushing the second engaging surfaces.

10 Claims, 12 Drawing Sheets

FAST EXPANSION STRUCTURE OF TOY GUN BUTTSTOCK

TECHNICAL FIELD OF THE INVENTION

The present invention relates to a fast expansion structure of a toy gun buttstock, and more particularly to a fast toy-gun-buttstock expansion structure that enables straight pull of a toy gun buttstock to the end to realize direct fixing at a predetermined position so as to achieve an effect of fast expansion and also enhancement of a fixing strength of the toy gun buttstock.

DESCRIPTION OF THE PRIOR ART

Survival games are widely popular and loved by a large number of people. Simulation of battle fields to proceed with the games in either an indoor space or in an outdoor jungle always excites the game players. The most important tools of the survival games are the toy gun for combating in the games.

To improve comfort of operating the toy guns, a user may make adjustment of an expansion length of a toy gun buttstock by means of a pin provided in the toy gun buttstock. The user only needs to insert the pin into different locking slots to set the buttstock at a corresponding position.

However, such a process of adjusting the expansion length of the buttstock requires the user to pull out the pin in each time of adjustment. As a consequence, an adjustment structure involving a tenon pin and a mortise slot engageable with each other. There is always a tolerance between the tenon pin and the mortise slot, and consequentially, an excessively large force applied by a user may easily pull and move the buttstock to set the tenon pin in engagement with different mortise slots. Such an arrangement also suffers to certain inconvenience. For example, in case that the arm length and shooting habits of an operator require the tenon pin to be set in engagement with an intermediate one of the mortise slots, yet during the application of force to pull and move the buttstock, due to the force applied being excessively small or excessively large, the tenon pin may be mistakenly set in engagement with a front one or a rear one of the mortise slots, and as such, re-adjustment to the rear side or the front side may be necessary to set the position at an ideal location. This results in inconvenience of use. Further, due the above-discussed structural arrangement requiring the tolerance between the tenon pin and the mortise slot for making the adjustment, the buttstock, after being correctly positioned, is easy to shake.

SUMMARY OF THE INVENTION

The primary objective of the present invention is that by alternately setting a limiting member to contact and push a first engaging surface and a second engaging surface, a user is allowed to pull the toy gun buttstock straight to the end for directly fixing and positioning, thereby achieving an effect of fast expansion and also improving a fixing strength of the toy gun buttstock.

To achieve the above objective, the present invention provides a main structure that comprises a main body. The main body is provided with a plurality of slide bars slidably mounted thereto. The slide bars are formed with a plurality of coupling portions. The coupling portions are provided with a plurality of fixing members mounted thereto. The slide bars are connected, at one side thereof, to a butt piece. The main body is provided with a plurality of rotating and retaining members rotatably mounted thereto. Each of the rotating and retaining members corresponds to and is engageable with and retainable by each of the fixing members. Each of the rotating and retaining members is formed with a first engaging surface and a second engaging surface at one side of the first engaging surface. Further, the main body is also provided with a limiting member and a first elastic member arranged between an inside wall of the main body and the limiting member.

With the above structure, a user pulling the butt piece would cause the slide bars that are connected to the butt piece to slide backward and thus, the fixing members provided on the slide bars may push the rotating and retaining members, such that the rotating and retaining members so pushed would rotate due to the arrangement of being rotatably mounted to the main body, making the limiting member that is initially in a condition of contacting and pushing the first engaging surfaces switched to a condition of contacting and pushing the second engaging surfaces as being pushed and biased by the first elastic member. Under such a condition, the limiting member is subject to positional constraint by the rotating and retaining members on two sides thereof to thereby fix the length of the toy gun buttstock after being so expanded.

To push the butt piece back to the initial position, the user only need to push, from the lower side, the limiting member that is pushed and biased by the first elastic member to shift the limiting member upward to contact and push the first engaging surfaces, and then, the butt piece is pushed to have the fixing members that are mounted to 於 the slide bars to push the rotating and retaining members away to cause the rotating and retaining members to rotate back to the initial position thereby collapsing and closing the butt piece.

Such a structural arrangement allows a user to only pull the toy gun buttstock straight to the end to directly fix the toy gun buttstock in a predetermined position to thereby achieve an effect of fast expansion and also improving a fixing strength of the toy gun buttstock.

Based on the above technique, the shortcomings of the prior art that operation of a structure for adjusting an expansion length of a toy gun buttstock is inconvenient and the toy gun buttstock still suffers shaking after being position can be overcome to achieve practical improvement that realizes the above-discussed advantages.

DETAILED DESCRIPTION OF THE PREFERRED EMBODIMENT

Figure 1:
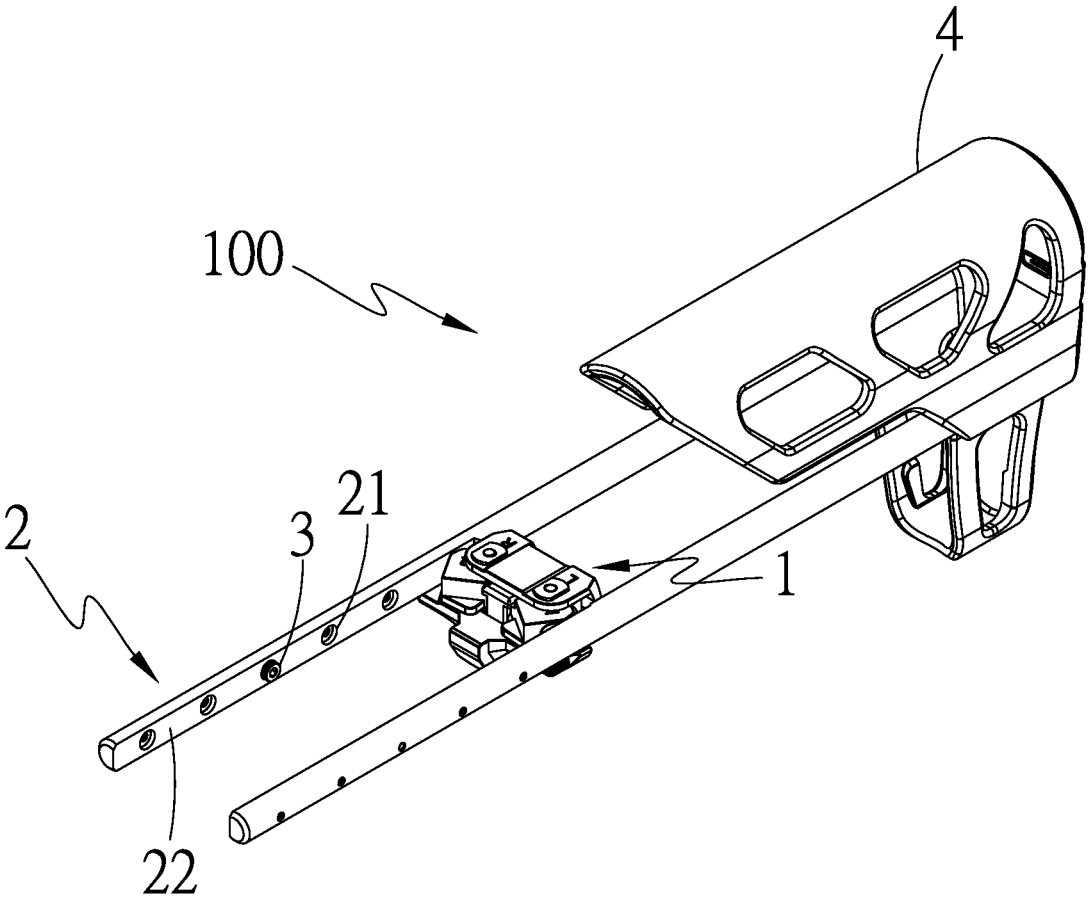
FIG. 1 is a perspective view of a preferred embodiment of the present invention.
Figure 2:
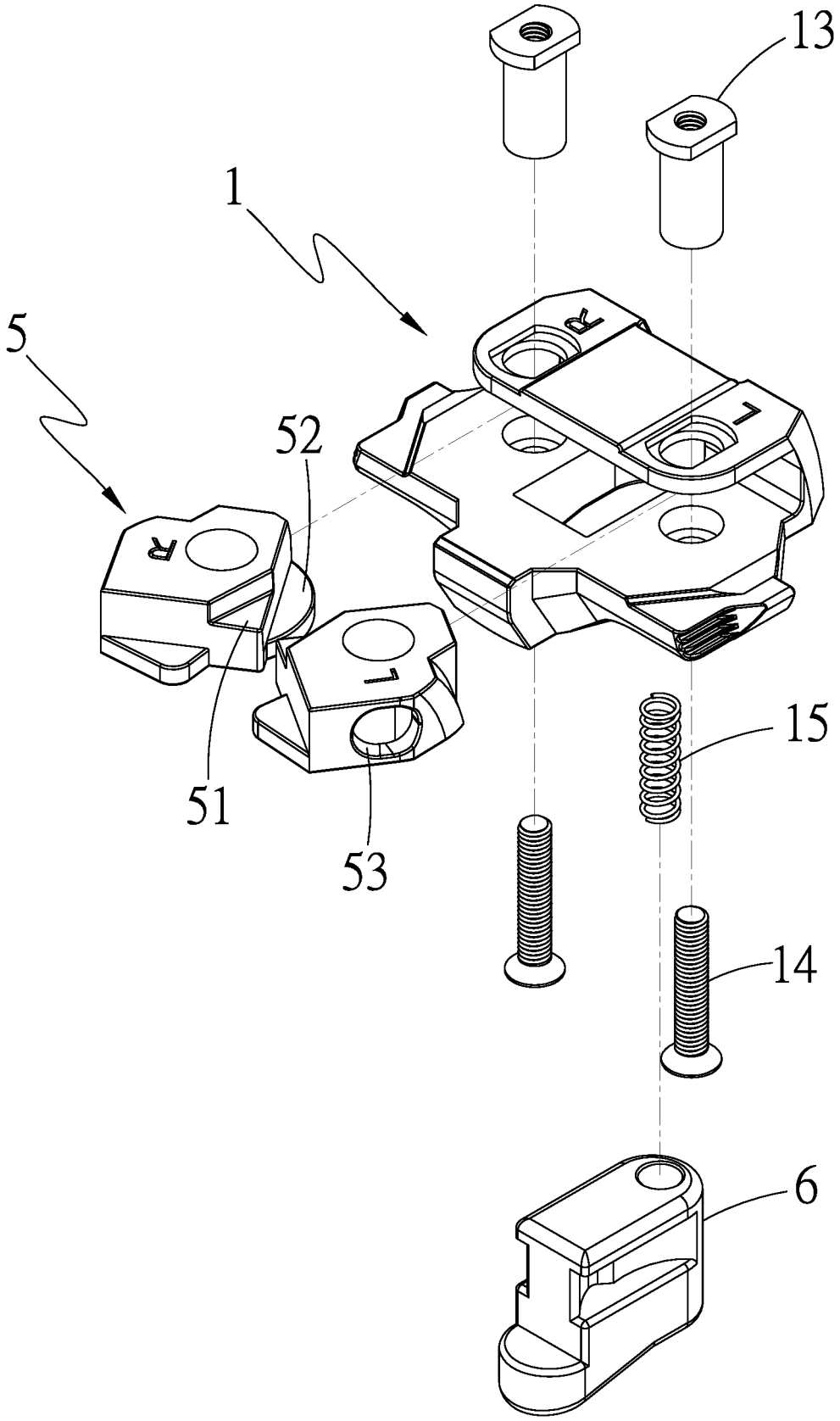
FIG. 2 is an exploded view of a portion of the preferred embodiment of the present invention.

Referring to FIGS. 1 and 2, which are respectively a perspective view of a preferred embodiment of the present invention and an exploded view of a portion of the preferred embodiment of the present invention, it can be seen from the drawings that a toy gun buttstock 100 according to the present invention comprises:

a main body 1;

a plurality of slide bars 2, the slide bars 2 being slidably mounted on the main body 1;

a plurality of coupling portions 21, the coupling portions 21 being formed on each of the slide bars 2;

a plurality of fixing members 3, each of the fixing members 3 being mounted to each of the coupling portions 21;

a butt piece 4, the butt piece 4 being connected to one side of the slide bars 2;

a plurality of rotating and retaining members 5, the rotating and retaining members 5 being rotatably mounted in the main body 1 and corresponding to and engageable with and retainable by the fixing members 3, each of the rotating and retaining members 5 being formed with a first engaging surface 51 and a second engaging surface 52 at one side of the first engaging surface 51;

a limiting member 6, the limiting member 6 being arranged in the main body 1; and a first elastic member 15, the first elastic member 15 being arranged between an inside wall of the main body 1 and the limiting member 6 so as to provide a spring force that causes the limiting member 6 to contact and push each of the first engaging surfaces 51 and each of the second engaging surfaces 52.

In such an arrangement, each of the slide bars 2 is formed with a planar portion 22 on one side thereof adjacent to each of the rotating and retaining members 5.

In such an arrangement, the toy gun buttstock 100 comprises a plurality of first coupling members 13 penetrating into and arranged in the main body 1 and each of the rotating and retaining members 5 and a plurality of second coupling members 14 penetrating into and arranged in each of the rotating and retaining members 5 and each of the first coupling members 13.

In such an arrangement, each rotating and retaining member 5 is formed with a retaining slot 53 corresponding to and in contact engagement with the fixing members 3.

Preferably, as an example of illustration, the number of the slide bars 2 and the fixing members 3 are each two.

Preferably, the coupling portions 21 are threaded holes formed in the slide bars 2, and, as an example of illustration, the number of the coupling portions 21 on each of the slide bars 2 is five.

Preferably, the fixing members 3 are bolts.

Preferably, the first elastic member 15 is a spring.

The above description provides an illustration of the structure of the present invention, and based on a collaborative combination of such a structure, it only needs a user to pull the toy gun buttstock 100 straight to the end to realize direct fixing and positioning of the toy gun buttstock 100 so as to achieve an effect of fast expansion, and also helping increase a fixing strength of the toy gun buttstock 100. A more detailed description will be provided below.

Figure 3:
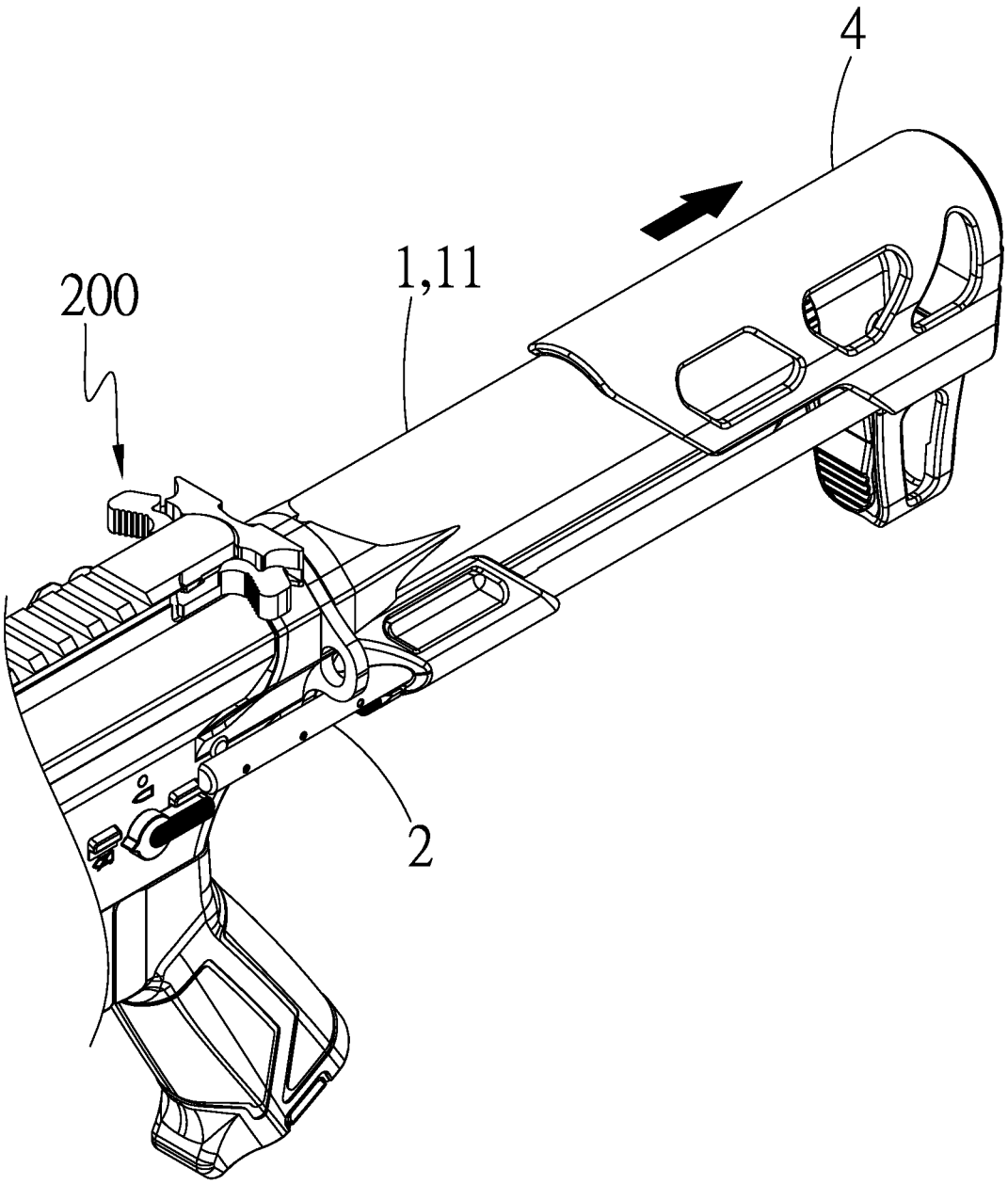
FIG. 3 is a schematic view demonstrating pulling of the preferred embodiment of the present invention.
Figure 4:
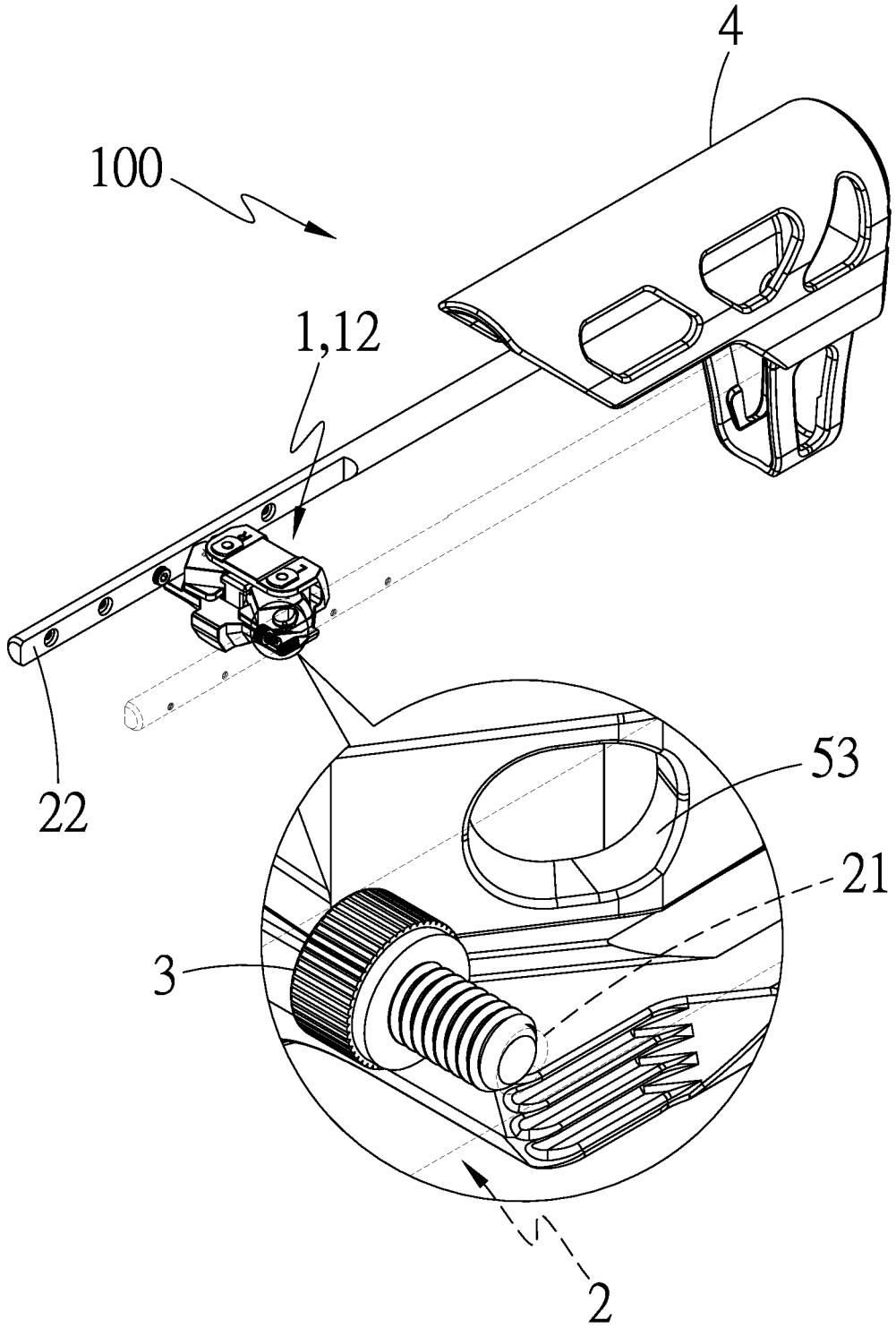
FIG. 4 is a schematic view demonstrating fixing of the preferred embodiment of the present invention.
Figure 5:
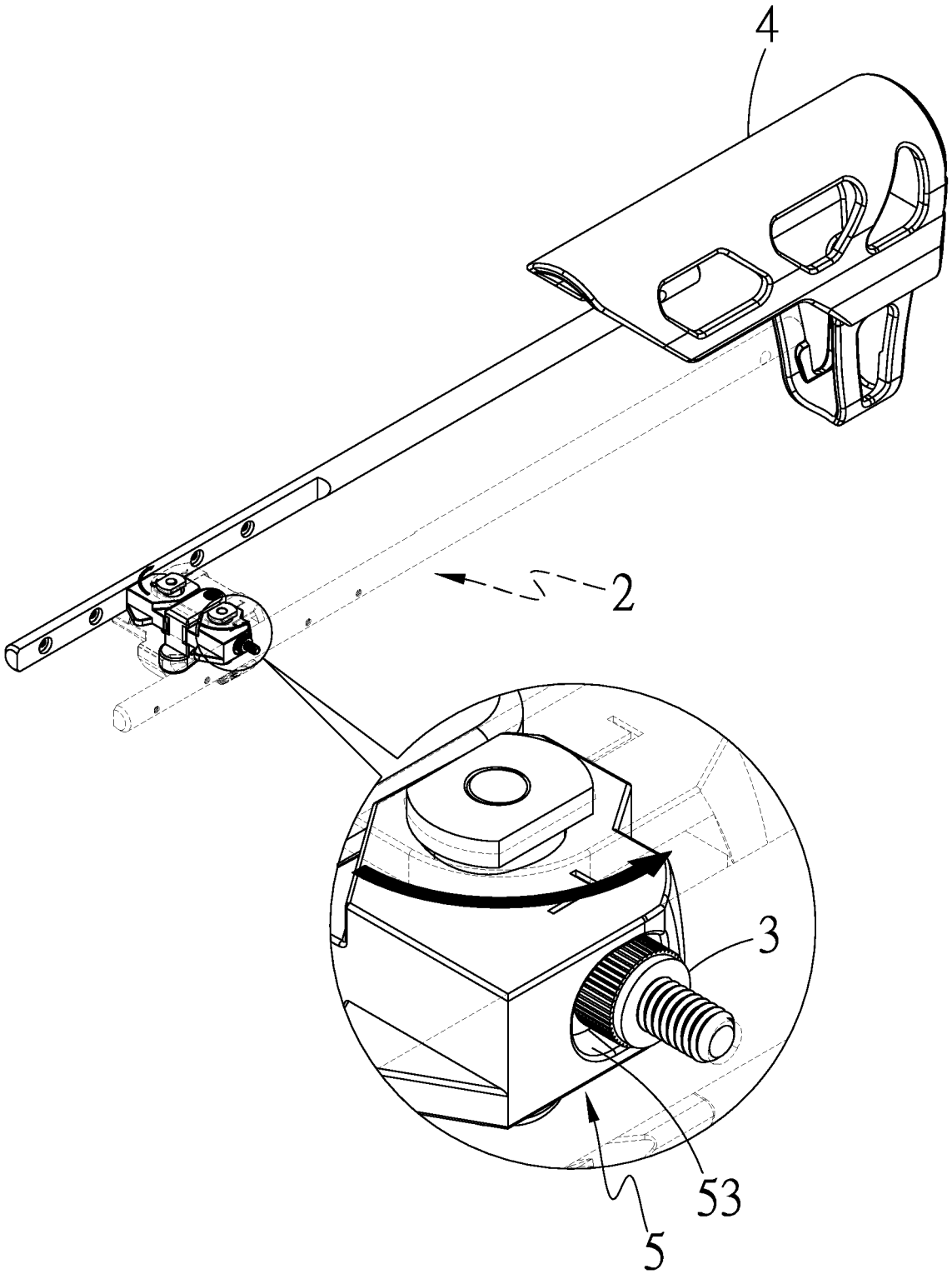
FIG. 5 is a schematic view demonstrating rotating of the preferred embodiment of the present invention.

Referring to FIGS. 1-7, which are respectively a perspective view of a preferred embodiment of the present invention, an exploded view of a portion of the preferred embodiment of the present invention, a schematic view demonstrating pulling of the preferred embodiment of the present invention, a schematic view demonstrating fixing of the preferred embodiment of the present invention, a schematic view demonstrating rotating of the preferred embodiment of the present invention, a schematic view demonstrating down shifting of the preferred embodiment of the present invention, and a schematic view demonstrating collapsing of the preferred embodiment of the present invention, based on the assembled combination of the above structure, it can be clearly seen from the drawings that the main body 1 of the toy gun buttstock 100 according to the present invention is connectable with a toy gun 200, and the main body 1 further comprises an outer casing 11 and a mounting base 12 arranged inside the outer casing 11. A user, when attempting to adjust an expansion length of the toy gun buttstock 100, may first pull the butt piece 4 backward (as shown in FIG. 3), and the slide bars 2 that are connected to the butt piece 4 are consequentially moved backward in unison therewith, such that the fixing members 3 that are located on the coupling portions 21, when brought into contact engagement with the retaining slots 53 formed in the rotating and retaining members 5 (as shown in FIG. 4), drive the rotating and retaining members 5 that are rotatably mounted on the main body 1 to cause the rotating and retaining members 5 to rotate and outward extend (as shown in FIG. 5), and under such a condition, the rotating and retaining members 5 press outward against the planar portions 22 of the slide bars 2.

Figure 6:
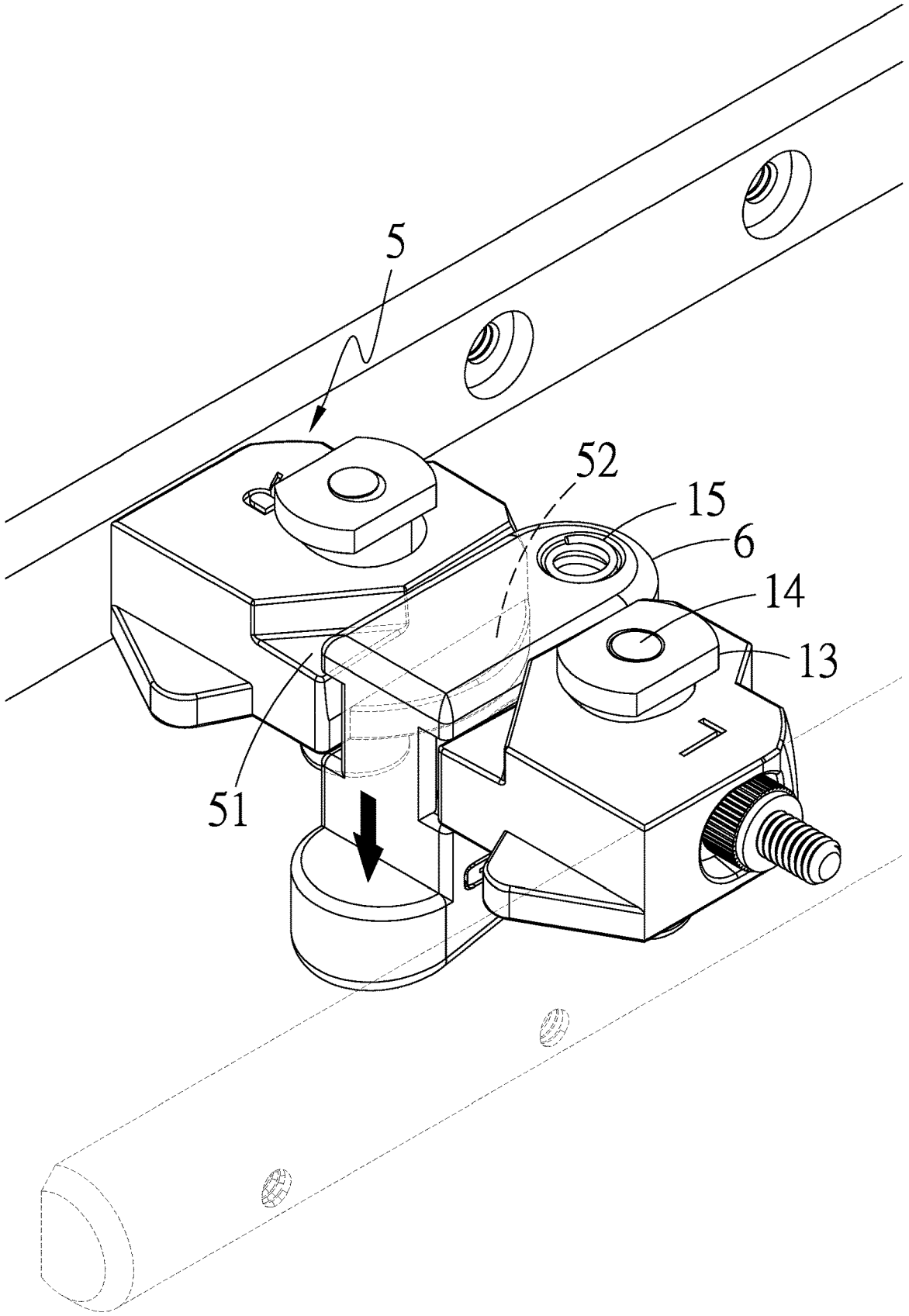
FIG. 6 is a schematic view demonstrating down shifting of the preferred embodiment of the present invention.
Figure 7:
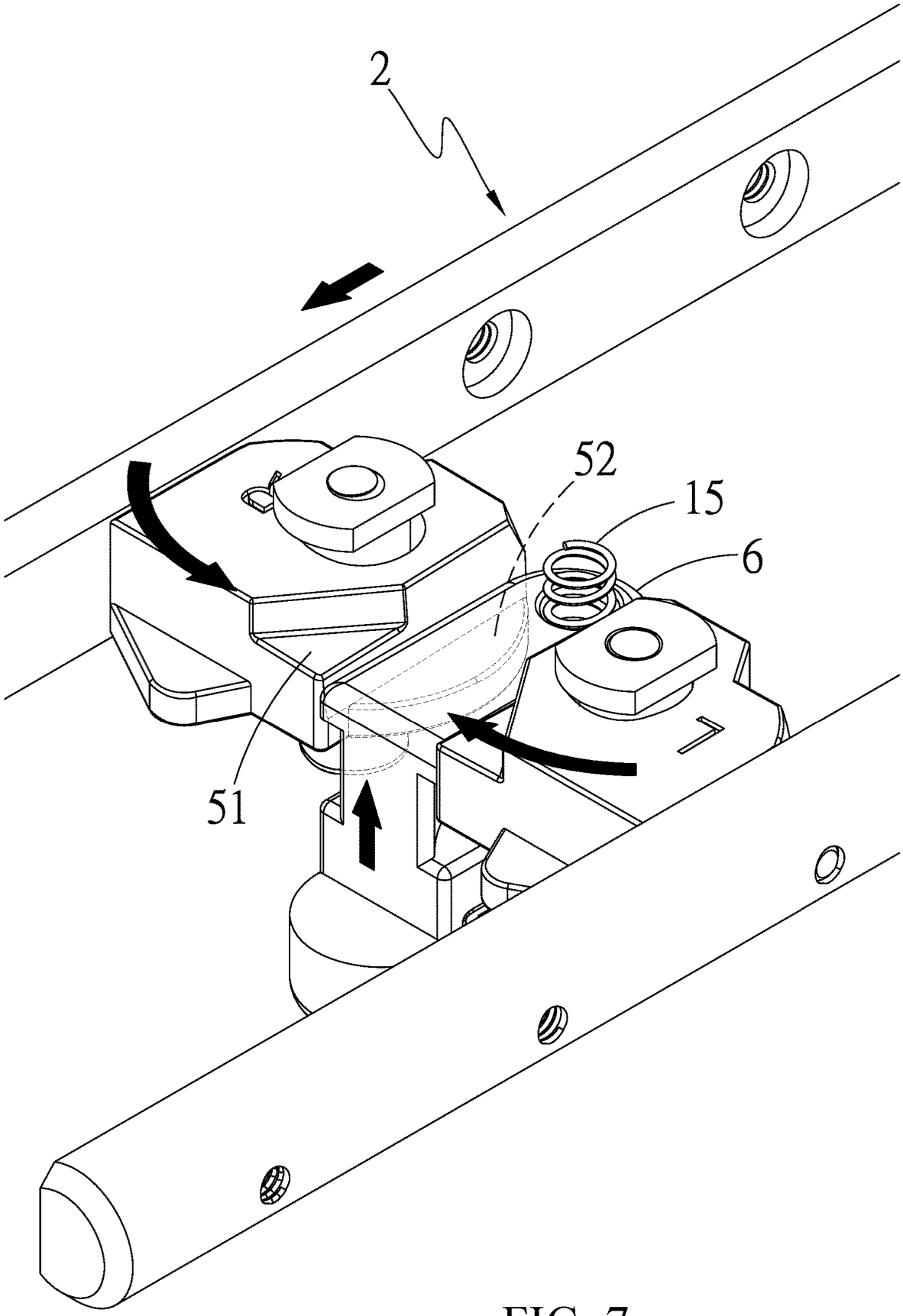
FIG. 7 is a schematic view demonstrating collapsing of the preferred embodiment of the present invention.
Figure 8:
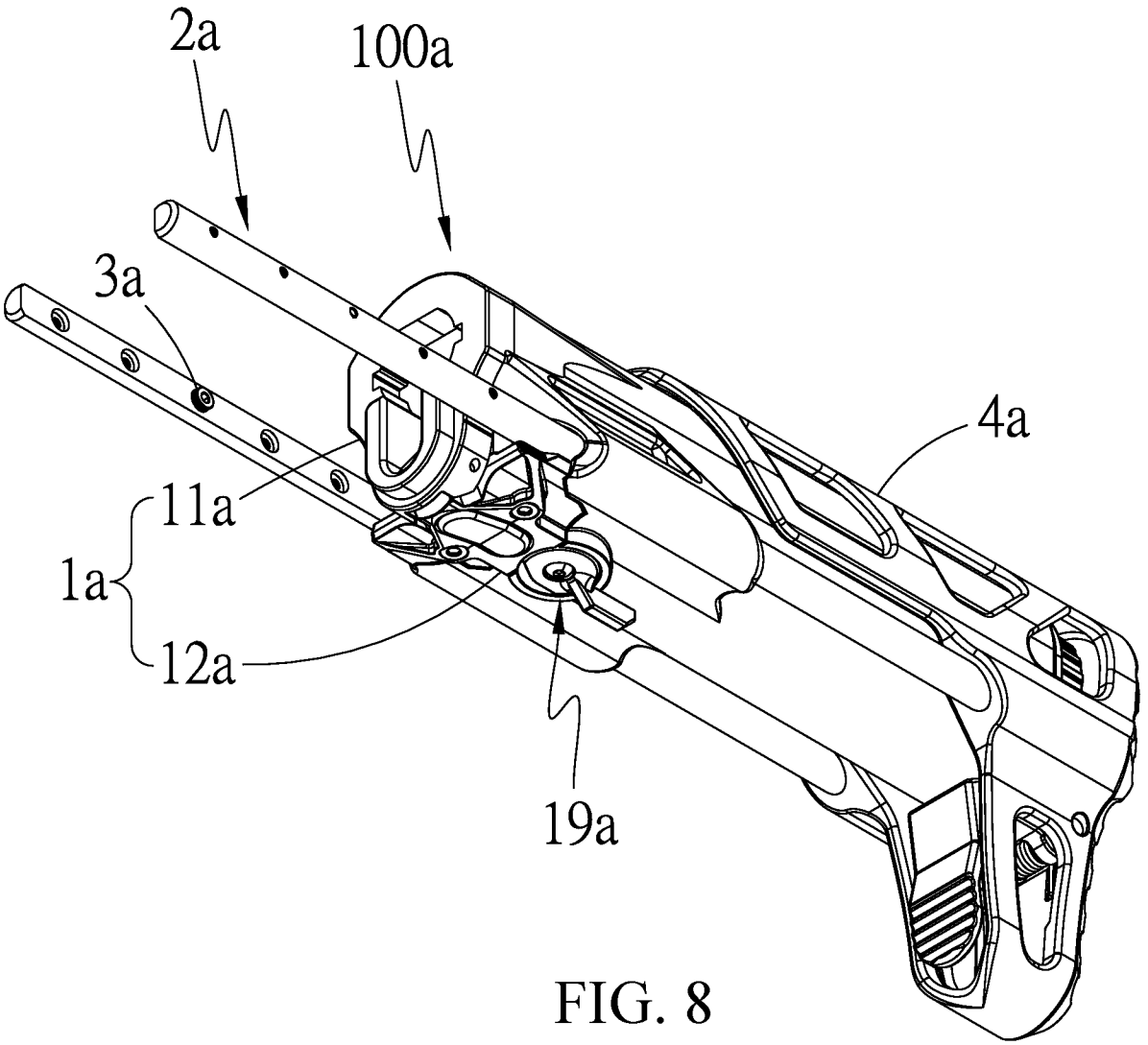
FIG. 8 is a perspective view of another preferred embodiment of the present invention.
Figure 9:
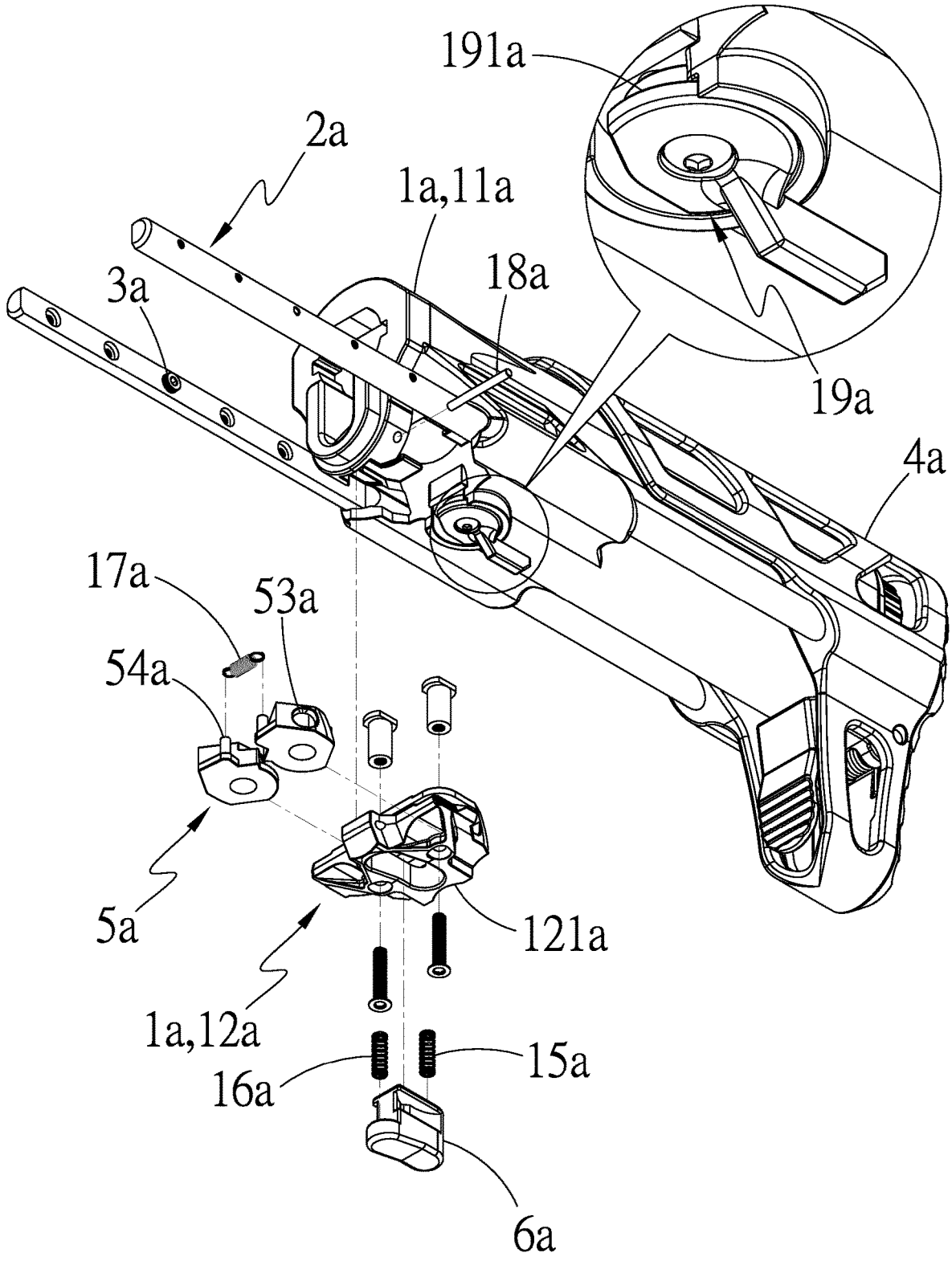
FIG. 9 is an exploded view of said another preferred embodiment of the present invention.

When the rotating and retaining members 5 are not yet rotated, the limiting member 6 are set in contact engagement with the first engaging surfaces 51, and when the rotating and retaining members 5 are rotated, the limiting member 6 that is originally in contact engagement with the first engaging surfaces 51 is pushed by the first elastic member 15 to shift downward so as to get in contact engagement with the second engaging surfaces 52 (as shown in FIG. 6). As such, the limiting member 6 that is so in contact engagement with the second engaging surfaces 52 generates an effect of fixing the rotating and retaining members 5 to thereby make the toy gun buttstock 100 positioned at such a location.

Thus, based on such an arrangement that the limiting member 6 is alternatively set in contact engagement with the first engaging surfaces 51 and the second engaging surfaces 52, in combination with the structural arrangement that the rotating and retaining members 5 are rotatably mounted on the mounting base 12, in each time of use, the user only needs to pull the toy gun buttstock 100 backward straight to directly reach the predetermined location for positioning and the toy gun buttstock 100 exhibiting a predetermined expansion length to thereby achieve an effect of fast expansion. Further, the limiting member 6, when set in contact engagement with the second engaging surfaces 52, is in a condition of being locked with and fixed together with the rotating and retaining members 5 and the slide bars 2 so as to enhance an overall fixing strength.

To release the locking and fixing condition of the limiting member 6 and the rotating and retaining members 5, in order to collapse and close the butt piece 4 frontward, the user pushes the limiting member 6 upward to make the limiting member 6 disengage from the second engaging surfaces 52, and then moves the butt piece 4, together with the slide bars 2, frontward to allow the fixing members 3 to push the retaining slots 53 away and drive the rotating and retaining members 5 to rotate. At the moment, the user stops pushing the limiting member 6 upwards, and the limiting member 6 is brought into contact engagement with the first engaging surfaces 51 due to the rotation of the rotating and retaining members 5. The fixing members 3, which are no longer constrained by the retaining slots 53, allow the user to move the slide bars 2 frontward in a manner of being not obstructed to thereby achieve an effect of collapsing the toy gun buttstock 100.

Further, the structural arrangement of the planar portion 22 allows the rotating and retaining members 5 to be easily put into contact engagement therewith and also ease mounting of the fixing members 3 to the slide bars 2.

Further, the structural arrangement of the first coupling members 13 and the second coupling members 14 helps improve a coupling strength of the rotating and retaining members 5 and the main body 1, allowing the rotating and retaining members 5 to be rotatably mounted to the main body 1 in a stable manner.

Referring to FIGS. 8-12, which are respectively a perspective view of a preferred embodiment of the present invention, an exploded view of the preferred embodiment of the present invention, a schematic view demonstrating extending of a preferred embodiment of the present invention, a schematic view demonstrating unlocking of the preferred embodiment of the present invention, and a schematic view demonstrating dismounting of the preferred embodiment of the present invention, based on the assembled combination of the above structure, it can be clearly seen from the drawings that the instant embodiment is generally similar to the previous embodiment and in the instant embodiment, an ancillary elastic member 16*a* is arranged between the main body 1*a* and the limiting member 6*a*; each of the rotating and retaining members 5*a* is formed with a coupling peg 54*a*; the main body 1*a* comprises a second elastic member 17*a* having two ends mounted to the coupling pegs 54*a*; the mounting base 12*a* is formed with an axle member 18*a*, and the axle member 18*a* penetrating into and received in the outer casing 11*a*, such that the mounting base 12*a* is rotatably mounted to the outer casing 11*a*. Further, the outer casing 11*a* is provided with a closure member 19*a* corresponding to and locking the mounting base 12*a*. The mounting base 12*a* is formed with a base curved portion 121*a*, and the closure member 19*a* is formed with a closure curved portion 191*a* that corresponds to and is engageable with the base curved portion 121*a*.

Preferably, the second elastic member 17*a* is an extension spring.

Preferably, the ancillary elastic member 16*a* is a spring.

Based on the structural arrangement of the ancillary elastic member 16*a*, assistance is provided to the first elastic member 15*a* for pushing the limiting member 6*a*, so that after the rotation of the rotating and retaining members 5*a*, the limiting member 6*a* may be effectively moved the position of contact engagement with the first engaging surfaces.

Figure 10:
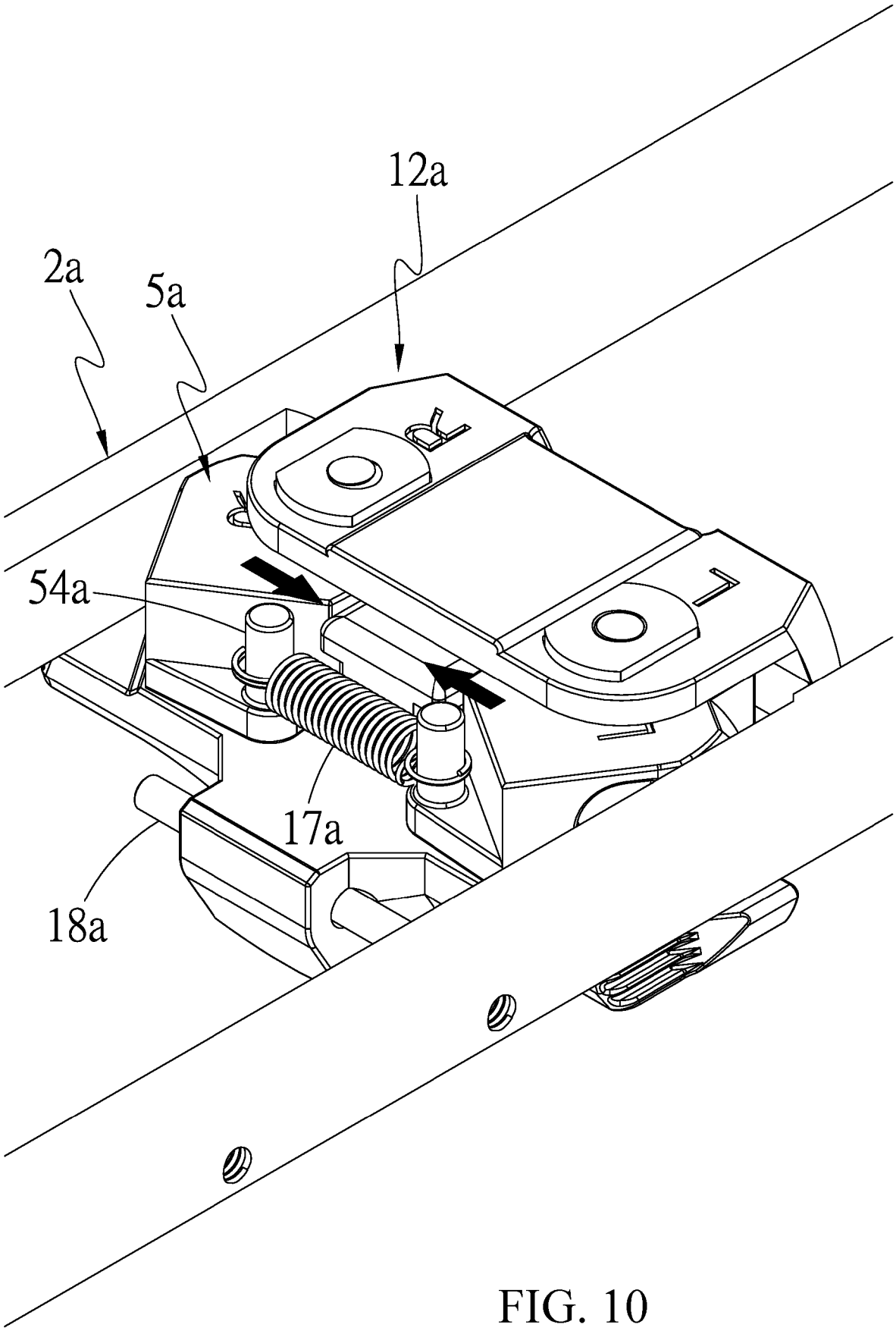
FIG. 10 is a schematic view demonstrating extending of a further preferred embodiment of the present invention.

In the instant embodiment, backward expansion of the butt piece 4*a* is carried out in a way similar to that of the previous embedment and thus repeated description will be omitted. To collapse and close the toy gun buttstock 100*a*, the user pushes the limiting member 6*a* upwards and the rotating and retaining members 5*a* are pulled inward by the second elastic member 17*a* mounted to the coupling pegs 54*a* (as shown in FIG. 10), so as to assist the rotating and retaining members 5*a* to rotate. As such, an event that the retaining slots 53*a* and the fixing members 3*a* are jammed together before the slide bars 2*a* are moved frontward can be avoided.

Figure 11:
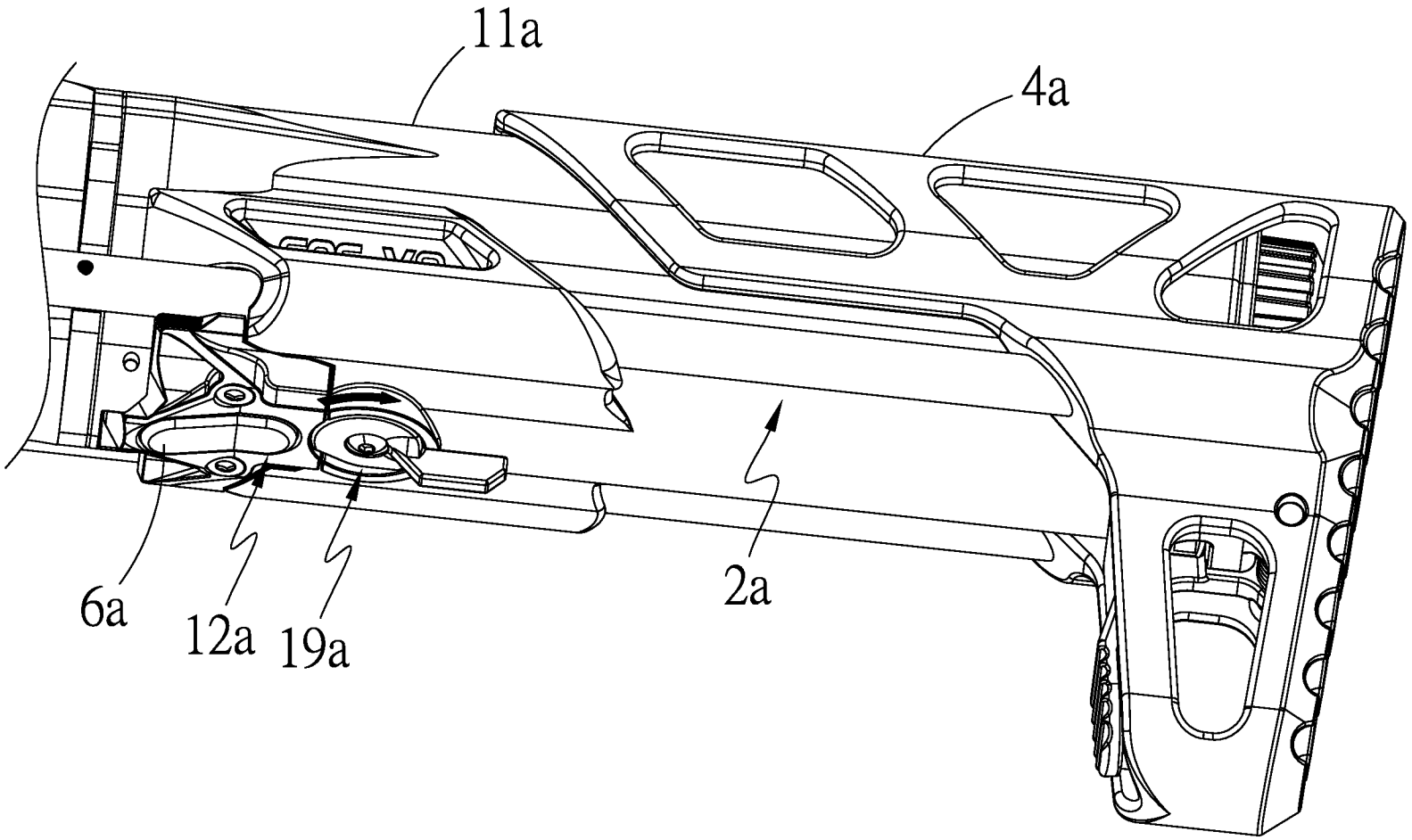
FIG. 11 is a schematic view demonstrating unlocking of said further preferred embodiment of the present invention.
Figure 12:
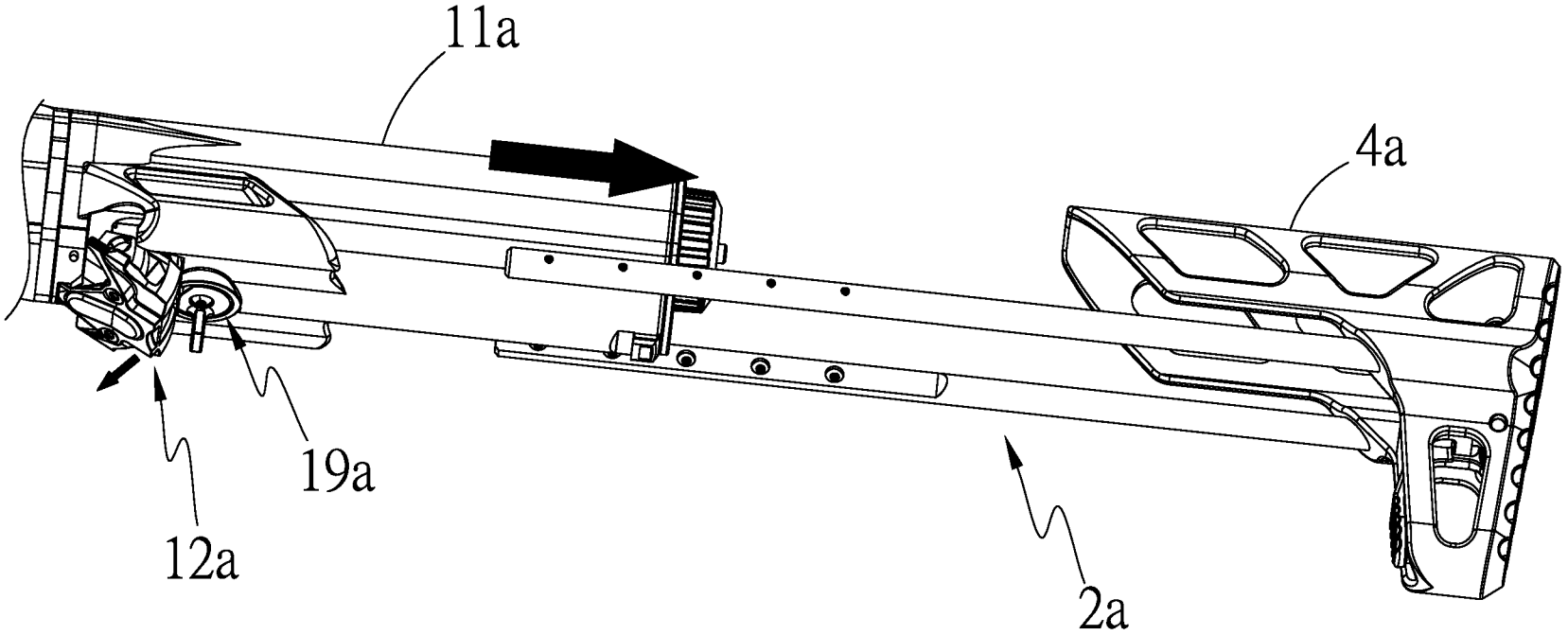
FIG. 12 is a schematic view demonstrating dismounting of said further preferred embodiment of the present invention.

It can be clearly seen from FIG. 11 that the closure member 19*a* is set in a condition of locking the mounting base 12*a* by means of the inter-engagement of the closure curved portion 191*a* and the base curved portion 121*a*. To remove the buttstock, the user may twist the closure member 19*a* to release the coupling engagement between the closure curved portion 191*a* and the base curved portion 121*a*. Based on the structural arrangement of the axle member 18*a*, the mounting base 12*a* is allowed to rotate about a center of rotation defined by the axle member 18*a* for a limited range (as shown in FIG. 12); however, also due to the axle member 18*a* that is set to penetrate into and received in the outer casing 11*a*, the mounting base 12*a* is not allowed to detach. At this moment, the user may pull the butt piece 4*a* backward to remove the slide bars 2*a* from the main body 1*a*, and as such, service and repairing of the butt piece 4*a* and the slide bars 2*a* can be performed. Further, the user may make use of this to proceed with adjustment of the mounting position of the fixing members 3*a*, in order to adjust the expansion length of the toy gun buttstock 100*a* to a desired length.

Thus, the fast expansion structure of the toy gun buttstock according to the present invention involves the following key technical features that improve the prior art:

Firstly, the limiting member 6 is alternately put in contact engagement with the first engaging surfaces 51 and the second engaging surfaces 52 to enable direct fixing for positioning through pulling the toy gun buttstock 100 straight backward to the end by the user, thereby achieving an effect of fast expansion and also increasing the fixing strength of the toy gun buttstock 100.

Secondly, the arrangement of the second elastic member 17*a* provides pulling to the rotating and retaining members 5*a* to prevent the retaining slots 53*a* and the fixing members 3*a* from jamming during frontward movement of the slide bars 2*a*.

Thirdly, the collaborative structural combination of the axle member 18*a* and the closure member 19*a* allows a user to remove the slide bars 2*a* and the butt piece 4*a* from the main body 1*a* in order to carry out service and repair of the slide bars 2*a* and the butt piece 4*a* and also allowing the user to make adjustment to the expansion length of the toy gun buttstock 100*a* to a desired length.

I claim:

1. A fast expansion structure of a toy gun buttstock, the toy gun buttstock mainly comprising:

a main body;

a plurality of slide bars, the slide bars being slidably mounted on the main body;

a plurality of coupling portions, the coupling portions being formed in each of the slide bars;

a plurality of fixing members, each of the fixing members being mounted to each of the coupling portions;

a butt piece, the butt piece being connected to one side of the slide bars;

a plurality of rotating and retaining members, the rotating and retaining members being rotatably mounted in the main body and corresponding to and engageable with and retainable by the fixing members, each of the rotating and retaining members being formed with a first engaging surface and a second engaging surface at one side of the first engaging surface;

a limiting member, the limiting member being arranged in the main body; and a first elastic member, the first elastic member being arranged between an inside wall of the main body and the limiting member so as to provide a spring force to cause the limiting member to contact and push each of the first engaging surfaces and each of the second engaging surfaces.

2. The fast expansion structure of the toy gun buttstock according to claim 1, wherein the main body is provided with a second elastic member having two ends mounted to each of the rotating and retaining members.

3. The fast expansion structure of the toy gun buttstock according to claim 2, wherein each of the rotating and retaining members is provided with a coupling peg, and the two ends of the second elastic member are attached to each of the coupling pegs.

4. The fast expansion structure of the toy gun buttstock according to claim 1, wherein the main body comprises a mounting base and an outer casing, and the mounting base being provided with an axle member, the axle member penetrating into and received in the outer casing to rotatably mount the mounting base to the outer casing.

5. The fast expansion structure of the toy gun buttstock according to claim 4, wherein the outer casing is provided with a closure member that corresponds to and selectively lock and fix the mounting base.

6. The fast expansion structure of the toy gun buttstock according to claim 5, wherein the mounting base is formed with a base curved portion and the closure member is formed with a closure curved portion corresponding to and engageable with and locking the base curved portion.

7. The fast expansion structure of the toy gun buttstock according to claim 1, wherein an ancillary elastic member is arranged between the main body and the limiting member.

8. The fast expansion structure of the toy gun buttstock according to claim 1, wherein each of the slide bars is formed with a planar portion on one side thereof adjacent to each of the rotating and retaining members.

9. The fast expansion structure of the toy gun buttstock according to claim 1, wherein the toy gun buttstock comprises a plurality of first coupling members penetrating into and received in the main body and each of the rotating and retaining members and a plurality of second coupling members penetrating into and received in each of the rotating and retaining members and each of the first coupling members.

10. The fast expansion structure of the toy gun buttstock according to claim 1, wherein the toy gun buttstock is connectable to a toy gun.

* * * * *